US006508065B1

(12) United States Patent
De Espindola et al.

(10) Patent No.: US 6,508,065 B1
(45) Date of Patent: Jan. 21, 2003

(54) SYSTEM AND A PROCESS FOR SUPPLYING FLUID IN HERMETIC CIRCUITS

(75) Inventors: Estevao Marino De Espindola, Joinville (BR); Vadis Bellini, Joinville (BR); Marcio Moacir Pereira, Joinville (BR); Eriberto Nelson De Souza, Joinville (BR); Paulo Geraldo Scheibe, Joinville (BR)

(73) Assignee: Multibras S.A. Eletrodomesticos, Sao Paulo (BR)

( * ) Notice: Subject to any disclaimer, the term of this patent is extended or adjusted under 35 U.S.C. 154(b) by 0 days.

(21) Appl. No.: 09/403,989

(22) PCT Filed: Feb. 19, 1999

(86) PCT No.: PCT/BR99/00015

§ 371 (c)(1),
(2), (4) Date: Nov. 10, 1999

(87) PCT Pub. No.: WO99/45330

PCT Pub. Date: Sep. 10, 1999

(51) Int. Cl.[7] ..... F25B 45/00

(52) U.S. Cl. ..... 62/77; 62/169; 62/170; 62/100; 62/268

(58) Field of Search ..... 62/169, 77, 170, 62/268, 100

(56) References Cited

U.S. PATENT DOCUMENTS

| | | | | | |
|---|---|---|---|---|---|
| 3,156,104 | A | * | 11/1964 | Norr et al. | 62/268 |
| 3,304,733 | A | * | 2/1967 | Coffman | 62/100 |
| 4,942,053 | A | * | 7/1990 | Franklin et al. | 426/524 |
| 5,088,293 | A | * | 2/1992 | Itou | 62/100 |
| 5,271,240 | A | * | 12/1993 | Detrick et al. | 62/268 |
| 5,829,258 | A | * | 11/1998 | Cho | 62/100 |
| 6,090,422 | A | * | 7/2000 | Taragan et al. | 426/231 |
| 6,116,030 | A | * | 9/2000 | Story | 62/7 |

* cited by examiner

*Primary Examiner*—William C. Doerrle
*Assistant Examiner*—Mark Shulman
(74) *Attorney, Agent, or Firm*—Darby & Darby

(57) ABSTRACT

The invention is a system and process for supplying fluid in hermetic circuits. The type of hermetic circuit is identified, and based upon this identification, vacuum and fluid supply conditions that are predetermined for the type of circuit are applied. Using the system and process, multiple types of hermetic circuits with varying operating conditions may be continually processed on a production line.

20 Claims, 3 Drawing Sheets

SYSTEM AND A PROCESS FOR SUPPLYING FLUID IN HERMETIC CIRCUITS

FIELD OF THE INVENTION

The present invention refers to a system and to a process for obtaining vacuum and for supplying fluid in hermetic circuits, particularly applied to refrigeration circuits of refrigeration appliances, such as refrigerators, freezers and air conditioners.

BACKGROUND OF THE INVENTION

The refrigeration appliances have a refrigeration circuit pressurized with a refrigerant fluid, for example isobutane, which should be introduced in this circuit free from impurities and humidity, in order to avoid, for instance, the oxidation of the components enclosed inside the hermetic housing of the compressor of said refrigeration appliances.

Before supplying the refrigerant fluid, it is necessary to submit the refrigeration circuit to a determined vacuum condition. This vacuum condition is achieved in a producing unit, where each type of refrigeration appliance, for example a freezer or an air conditioner, is processed in a specific vacuum system (carrousel or mono-via), which is connected to vacuum pumps for a determined time, in order to be submitted to a process of depressurization and dehydration, before being conducted to a supply station, where it will receive a proper charge of refrigerant fluid.

In order to receive the refrigerant fluid, each refrigeration appliance is disconnected from the respective vacuum pump and individually connected to a refrigerant fluid supply station in a subsequent step to the vacuum producing process. The vacuum may be obtained only in the low pressure side of the refrigeration circuit of the refrigeration appliance or, simultaneously, in both high and low pressure sides of said circuit, this choice being a function of the time available to the process and of the level of the vacuum to be obtained.

In order to be conducted to the supply station, each refrigeration appliance is disconnected from the vacuum station after the time interval programed for obtaining said vacuum has elapsed. However, the disconnections from the vacuum stations usually cause slight pressure failures in the refrigeration circuit, a vacuum recovery being therefore needed just after the connection in the supply station, requiring the supply stations to be equipped with an additional vacuum pump.

In another known processes, the vacuum production occurs in a vacuum producing unit, where several refrigeration units are connected to a single vacuum pump, of high capacity, or by means of multiple vacuum producing units, each having a pump with a sufficient capacity for a single refrigeration unit.

In all these systems, each unit of refrigeration appliance is disconnected from the respective vacuum pump and subsequently connected to the refrigerant fluid supply station in order to receive the respective charge of said fluid.

The processes for obtaining vacuum and for supplying refrigerant fluid in refrigeration appliances have some deficiencies, such as the vacuum failure during the successive disconnections, contamination of the refrigeration circuit with humidity, due to vacuum failure, thereby requiring a new vacuum producing step, before the refrigeration appliance receives the charge of refrigerant fluid.

Each new vacuum producing step for a refrigeration appliance requires a stop in the production line of the vacuum producing unit, in order to avoid that the hermetic circuits, which have been already processed and provided with a determined vacuum value, remain a long time without the respective charge of refrigerant fluid, which condition may be jeopardized, allowing, with time, humidity to penetrate inside the refrigeration circuit.

Another deficiency of the known techniques refers to the same processing time for all the refrigeration appliances to be processed for obtaining vacuum and refrigerant fluid supply.

DISCLOSURE OF THE INVENTION

Thus, it is an objective of the present invention to provide a system for supplying fluid in hermetic systems which, in a single producing unit, allows to obtain vacuum and the immediate supply of refrigerant fluid for different lines of refrigeration appliances. Another objective of the present invention is to provide a process for supplying fluid in hermetic systems, which avoids the possibility of vacuum failure in the refrigeration appliances in which the vacuum has been already produced, and which also avoids the need of additional steps for obtaining vacuum in the refrigeration appliances, further eliminating the interruptions in the process for obtaining vacuum and refrigerant fluid supply in the production line.

A further objective is to provide a system and a process for supplying refrigerant fluid, which allows to differentiate the time of each operational step in the production line, as a function of the needs of each said step, or of the processing times required for each type of refrigeration appliance.

Another objective of the invention is to provide a process, such as mentioned above, which minimizes the possibility of contaminating the refrigeration circuit which is going to receive the refrigerant fluid.

These and other objectives are achieved by a system for supplying fluid in hermetic circuits, comprising: a plurality of processing cells, which will receive, individually, a hermetic circuit; a plurality of connecting means, which are each mounted to a respective processing cell and coupleable to the hermetic circuit received therein and connected to a vacuum pump and to a fluid supply source, in order to selectively and sequentially submit said hermetic circuit to vacuum and fluid supply conditions; and a control unit, which is operatively connected to each connecting means, in order to control the operation of the connecting means, so as to selectively and sequentially produce in the hermetic circuit the desired vacuum and fluid supply conditions.

The objectives of the present invention are further attained by a process for supplying fluid in hermetic circuits, comprising the following steps: a- positioning a hermetic circuit in a processing cell; b- connecting the hermetic circuit, in a processing cell, to a respective connecting means connected to a vacuum pump and to a fluid supply source; c- providing a selective and sequential fluid communication of the connecting means with the vacuum pump and with a respective fluid supply source, in order to instruct the production of vacuum in said hermetic circuit; and d- instructing, in the processing cell where is found the hermetic circuit, the supply of a fluid charge to said hermetic circuit, after a determined vacuum condition has been obtained in the latter.

BRIEF DESCRIPTION OF THE DRAWINGS

The invention will be described below, with reference to the attached drawings, in which.

BEST MODE OF CARRYING OUT THE INVENTION

Figure 1:
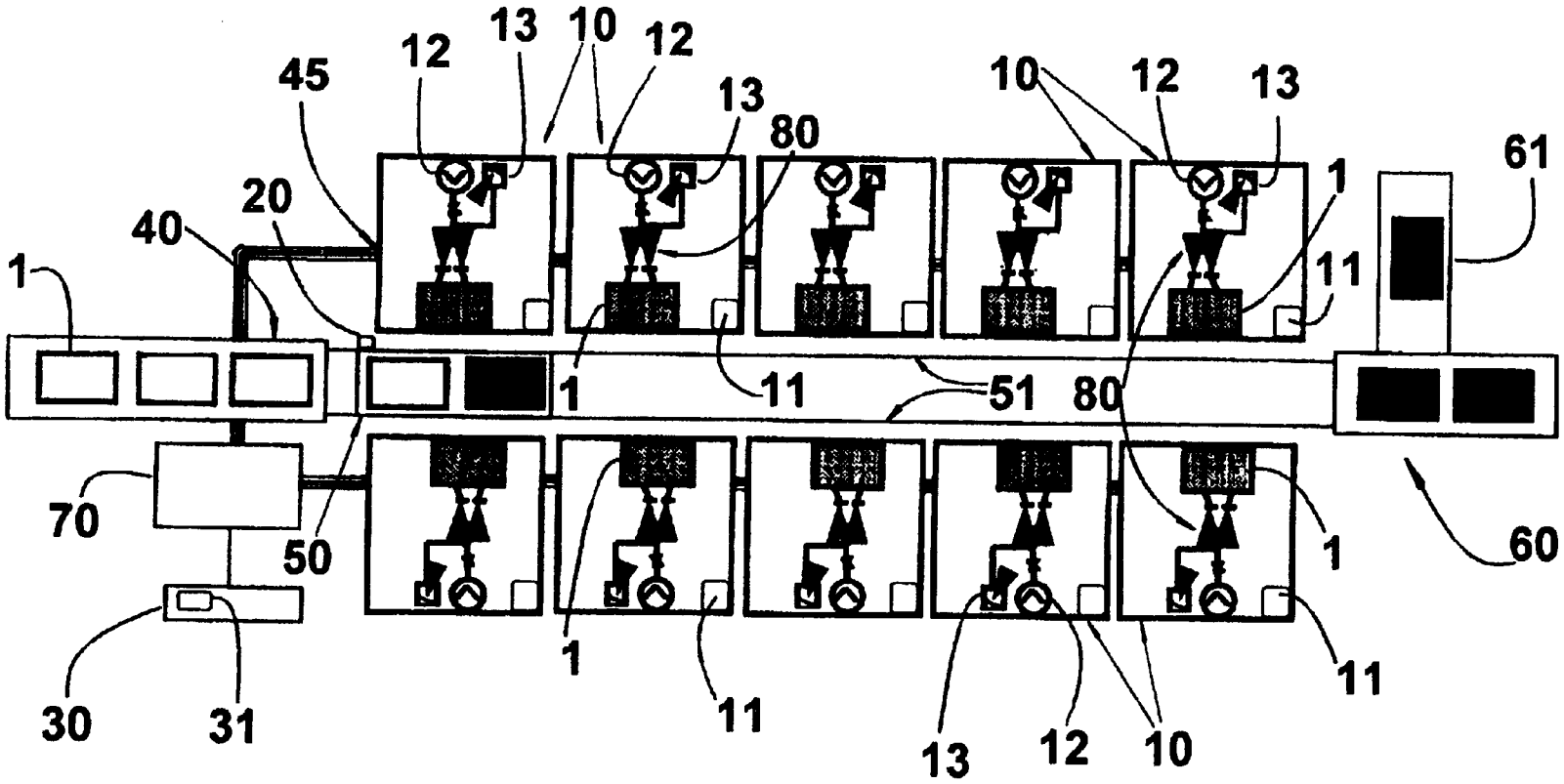
FIG. 1 illustrates, schematically and in a block diagram, a production line for obtaining vacuum and refrigerant fluid supply in hermetic circuits of refrigeration appliances, constructed according to the present invention.
Figure 2:
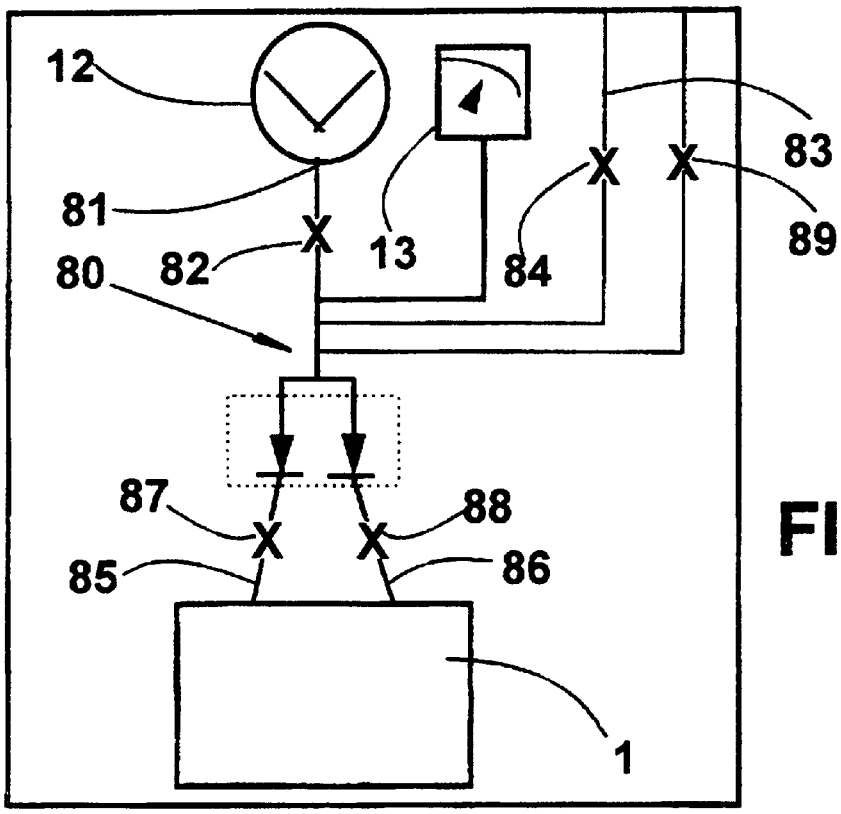
FIG. 2 illustrates, schematically, part of the production line shown in FIG. 1.
Figure 3:
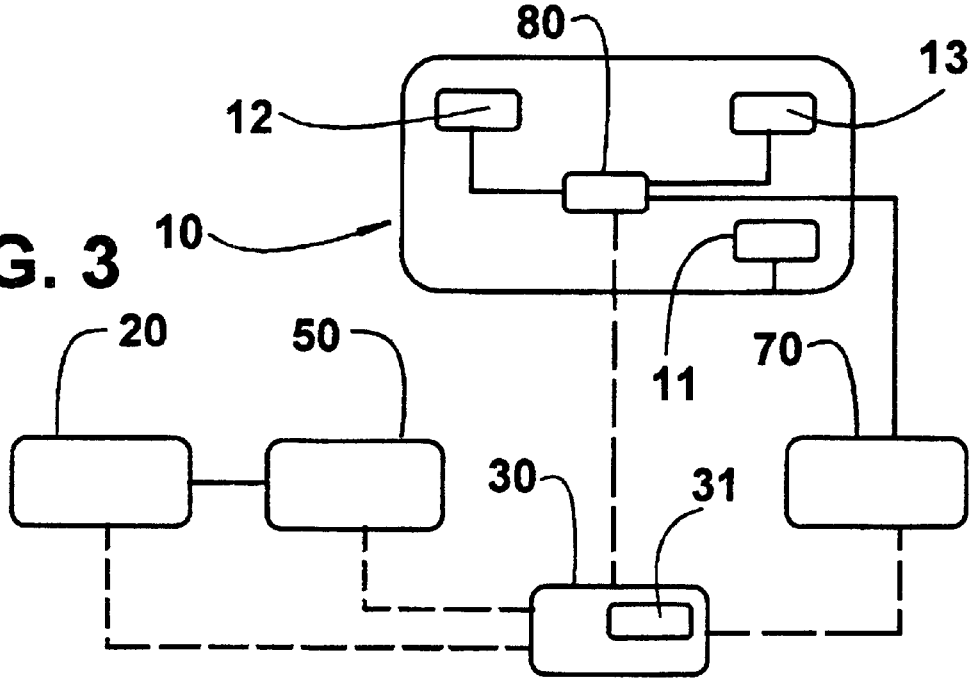
FIG. 3 illustrates, schematically and in a block diagram, the processing steps for the operation of the system for supplying refrigerant fluid of the present invention.

The present invention refers to a system and to a process for supplying fluid in hermetic circuits 1, such as the refrigeration circuits of a refrigeration appliance provided with a hermetic compressor. In the fluid supply system of the present invention, each hermetic circuit 1 is initially submitted to a vacuum condition and subsequently, without moving said hermetic circuit 1 from its place, it is submitted to a supply condition, in which it receives a certain charge of refrigerant fluid, which is calculated as a function of each type of refrigeration appliance being processed.

According to the present invention and with the illustrations in the appended drawings, the system for supplying fluid in hermetic circuits comprises a plurality of processing cells or gondolas 10, which may, for example, be programed, so that each receives, individually and sequentially, a hermetic circuit 1 to be initially submitted to a vacuum condition and subsequently, in the same processing cell 10 in which the vacuum condition has been obtained, to a fluid supply condition, which is calculated as a function of the type of hermetic circuit 1 which is being processed and which has been initially identified by a reading unit 20 operatively connected to a control unit 30, as discussed below.

According to the present invention, each hermetic circuit 1 to be processed is conducted to a receiving position 40, for example by a belt conveyor, in which the reading unit 20, for example a bar code optical reader, identifies each hermetic circuit 1 received thereon, informing said identification to the control unit 30, which will determine the conduction of the identified hermetic circuit to a respective processing cell 10, where it will be submitted to a previously established vacuum condition and subsequently to a charge of refrigerant fluid.

The optical reading identifies the code of the hermetic circuit 1, its type of compressor and the vacuum and fluid charge conditions that a processing cell 10 should provide to allow said identified hermetic circuit 1 to be processed. The data read by the reading unit 20 are sent to the control unit 30 which has, stored in a memory unit 31, process parameters which are previously known and defined for each type of hermetic circuit 1 and which will be used for executing the processing of each different type of hermetic circuit 1, for a future evaluation of the result of this processing by the control unit 30.

Each hermetic circuit 1 is conducted, individually, to a respective processing cell 10 through a conveying means 50, which is displaced between a receiving position 40 and a positioning position 45 in a respective processing cell 10, which is vacant and determined by the control unit 30.

According to a mode of carrying out the present invention, the conveying means 50 is in the form of a conveying carriage, which slides on guide-rails 51 communicating the receiving position 40 with an exiting position 60, in which each already processed hermetic circuit 1 is removed from the present system. These operations are commanded by the control unit 30, which determines the displacement of said hermetic circuits according to one of the conditions of operational time interval and detection of the positioning of each hermetic circuit 1 in different previously established operational positions, said detection occurring by means of a plurality of sensors (not illustrated).

According to a mode of carrying out the present invention, the identification of each hermetic circuit 1 occurs in the conveying means 50, which carries the reading unit 20.

It should be understood that, according to the present invention, the refrigerant fluid supply system may include, in each processing cell 10, a respective reading unit 20, which is operatively coupled to the control unit 30 and which identifies, either automatically or manually, a hermetic circuit 1 conducted to a respective processing cell 10 and sends these data to the control unit 30. The reading unit 20 may be affixed to the part in which it is provided or it may be movable, such as a remote reading unit manually actuated by an operator.

The fluid supply system of the present invention further has an occupation identifying means 11, for example in the form of a presence sensor provided in each one of the processing cells 10 and operatively requiring distinct charges. However, it should be understood that the fluid supply system of the present invention may have a plurality of supply sources 20, each connectable with at least one processing cell 10. When sending instruction for conducting a hermetic circuit 1 to a determined processing cell 10, the control unit 30 also commands the energization of a respective connecting means 80 contained inside the processing cell 10 which is able to receive a hermetic circuit 1 and which may start, upon arrival of the hermetic circuit 1, the vacuum producing process and the subsequent supply of refrigerant fluid. The instruction for energization may be also effected when the hermetic circuit 1 arrives to the respective processing cell 10 in which it will be processed. Each connecting means 80 is mounted to a respective processing cell 10 and coupleable to the hermetic circuit 1 received therein and operatively associated with a vacuum pump 12, a vacuum gauge 13 and to a respective fluid supply source 70, in order to selectively and sequentially submit each hermetic circuit 1 received in the processing cell 10 to vacuum and pressurizing conditions. Each connecting means 80 is operatively connected with the control unit 30, in order to be commanded by the latter to selectively and sequentially produce in the hermetic circuit 1 the desired vacuum and supply conditions.

Each connecting means 80 is in the form of a manifold, having a vacuum terminal 81 connected to a respective vacuum pump 12 of the processing cell 10 where it is located, and being provided with a first valve element 82 which selectively allows the fluid communication between the vacuum pump 12 and the hermetic circuit 1; a pressurization terminal 83, connected to the fluid supply source 70 and provided with a second valve element 84, which selectively allows fluid communication between the fluid supply source 70 and the hermetic circuit 1; and at least one evacuation and charging terminal 85, which is connectable to a nozzle provided in the hermetic circuit 1, selectively connecting each of the parts defined by the vacuum pump 12 and fluid supply source 70 to said hermetic circuit 1, when one of the first and second valve elements 82, 84 allows the respective fluid communication with this hermetic circuit 1.

According to the present invention, since the hermetic circuit 1 is a hermetic circuit 1 of refrigeration, having a nozzle in the high pressure side and a nozzle in the low pressure side of the compressor, the connecting means 80 has a pair of evacuation and charging terminals 85, 86, one of which being mounted in the low pressure side of the circuit and provided with a third valve element 87, while the other is mounted in the high pressure side of the circuit and provided with a fourth valve element 88.

After each hermetic circuit 1 to be processed has arrived in a respective processing cell 10, the control unit 30 instructs, initially, the opening of the first valve element 82 of at least one of the third and fourth valve elements 87, 88, as well as the activation of a respective vacuum pump 13, which will act on the refrigeration circuit of the hermetic circuit 1, until a determined pre-established vacuum condition has been obtained. According to the present invention, each processing cell 10 includes a respective vacuum pump 12.

Since the hermetic circuit is a refrigeration circuit comprising a hermetic compressor, during the evacuation process, the control unit 30 instructs, simultaneously with the opening of the first and third valve elements 82 and 87, the opening of the fourth valve element 88, allowing vacuum to be obtained in both the high and low pressure sides of the refrigeration hermetic circuit 1.

During the actuation of the vacuum pump 12, the control unit 30 keeps deactivated, and thus in a respective usually closed condition, the second valve element 84, avoiding the fluid communication between the supply source 70 and the hermetic circuit 1 which is being evacuated.

Each processing unit 10 further has a vacuum gauge 13, for example of the electronic type, which informs the control unit 30 of the different pressure conditions to be measured in the refrigeration circuit.

In a constructive option of the present invention, as a function of the characteristics of the hermetic circuit 1 identified by the reading unit 20, the control unit 30 determines to conduct this circuit to a processing cell 10 which is adequate to operate with that specific type of hermetic circuit 1.

Upon arrival of a hermetic circuit 1 in a respective processing cell 10 programed to receive it, an operator promotes the coupling of each terminal of a corresponding connecting means 80 with the nozzles of the high and low pressure sides of the hermetic circuit 1, indicating, for example manually, the coupling condition, so that to allow the control unit to instruct the opening of the first and fourth valve elements of the connecting means, as well as the activation of the vacuum pump 12.

The indication of the coupling, in another constructive option, may be automatically effected, for example after a determined time interval has elapsed after the coupling.

The control unit 30 stores the data relative to the whole process executed in each hermetic circuit 1 in a database of its memory unit 31 and uses said data in statistic analyses of the process and to follow up each hermetic circuit 1 being processed.

Upon obtaining the desired vacuum condition in each hermetic circuit 1, the control unit 30 sends command signals to the first, third and/or fourth valve elements 82, 87 and 88, instructing the closing thereof, as well as to the vacuum pump 12, deactivating the same. The control unit 30 then instructs the opening of the second, third and/or fourth valve element 82, 87 and 88, as well as the fluid supply by the fluid supply source 70.

After each hermetic circuit 1 has received the adequate charge of refrigerant fluid, the processing cell 10 sends this information to the control unit 30, which compares this information with the data in its database and then determines whether the supply condition which has been reached is the one desired for said hermetic circuit 1.

With the end of fluid supply to the hermetic circuit 1, a circuit closing means, not illustrated, closes each one of the nozzles of the hermetic circuit 1, interrupting the fluid communication between said hermetic circuit 1 and the environment thereof.

As a function of the analysis made between the data received from the processing cell 10 and those contained in its memory unit 31, the control unit 30 instructs the conveying means 50 to remove the processed hermetic circuit 1 from the processing cell 10 in which it is located and to conduct the same to the exiting position 60 or, alternatively, to a rejecting unit 61, whereto is conducted each processed hermetic circuit 1 not presenting a desired fluid supply condition according to the data available in the control unit 30.

After the valve elements of the connecting means 80 are closed, the operator, or the control unit 30, activates a command which instructs the release of the processed hermetic circuit 1, so that the conveying means 50 takes said hermetic circuit 1 from the processing cell 10 where it is found.

For the acceptance or rejection of each hermetic circuit 1 in a processing cell 10, during the process for supplying fluid to said hermetic circuit 1, measurements of the pressure condition are effected in the refrigeration circuit of said hermetic circuit 1, which measurements will indicate, initially, the vacuum and pressure conditions existing in that circuit, to be compared with the data previously defined as adequate in the control unit 30.

In a first processing step for obtaining vacuum in the hermetic circuit 1 to be supplied with fluid, after connecting to this circuit the respective connecting means 80 of the processing cell 10 in which said circuit is found, the control unit 30 instructs the opening of the first and third or of the fourth valve elements 82, 87 and 88 of the connecting means 80, allowing the fluid communication between be vacuum pump 12 and the hermetic circuit 1.

During this processing step, there occurs the rejection of the hermetic circuits 1 which, during a first verification step, which is carried out after a time interval t1 of actuation of the vacuum pump 12 has elapsed and in which the vacuum gauge 13 detects leakage and/or humidity in the refrigeration circuit, do not reach a pressure which is smaller than or equal to a determined value p1, detectable by the vacuum gauge 13 during the time instant t1.

Pressure p1 is the pressure for verifying leakage and/or humidity in the refrigeration circuit of the hermetic circuit 1 being processed in a specific processing cell 10. Pressures higher than p1 detected by the vacuum gauge 13 are informed to the control unit 30, which sends an instruction to the processing cell 10 for interrupting the processing of the hermetic circuit 1 with pressure p1, and instructs the conveying means 50 to go to the processing cell 10 with this hermetic circuit 1, further determining that the latter be conducted to the rejection unit 61 by the conveying means 50.

The control unit 30 will instruct the processing of each hermetic circuit 1 in the respective processing cell 10 to proceed, upon being informed that, after the time interval t1 has elapsed, the pressure measured by the vacuum gauge 13 is, at maximum, equal to pressure p1.

After this first verification of the processing condition of each hermetic circuit 1, the control unit 30 instructs to keep the first valve element 82 opened, allowing fluid communication to continue between the vacuum pump 12 and the refrigeration circuit of the hermetic circuit 1 being processed. After a time interval of actuation of the vacuum pump 12 has elapsed, the control unit 30 makes a second verification of the processing condition, in which it analyzes the data received from the vacuum gauge 13 and relative to a second pressure measurement in the refrigeration circuit of the hermetic circuit 1 being processed, said second pressure measurement being effected at a time instant t2, in which the pressure in said refrigeration circuit should be, at maximum, equal to p2, p2 being the lowest pressure of the refrigeration circuit for the type of hermetic circuit 1 being processed. During the time interval between t1 and t2, the hermetic circuit 1 being processed is conducted to a vacuum condition, which should be reached at the time instant t2.

If the pressure measured at the time instant t2 is higher than p2, the control unit 30 will instruct the processing cell 10 which is operating with said hermetic circuit 1 to reject the latter, such as it occurs in the first verification condition, for the time interval t1, since it considers the hermetic circuit 1 as being in an undesired vacuum and/or humidity condition.

When a vacuum pressure considered acceptable by the control unit 30 is reached, the latter instructs the closing of the first, third and/or fourth valve elements 82, 87, 88, interrupting the fluid communication between the vacuum pump 12 and the refrigeration circuit of the hermetic circuit 1 in the processing cell 10.

When a determined time interval for closing the first, third and/or the fourth valve elements 82, 87, 88 has elapsed, the control unit 30 instructs the vacuum gauge 13 to measure the pressure in the hermetic circuit 1 during a time instant t3.

Figure 4:
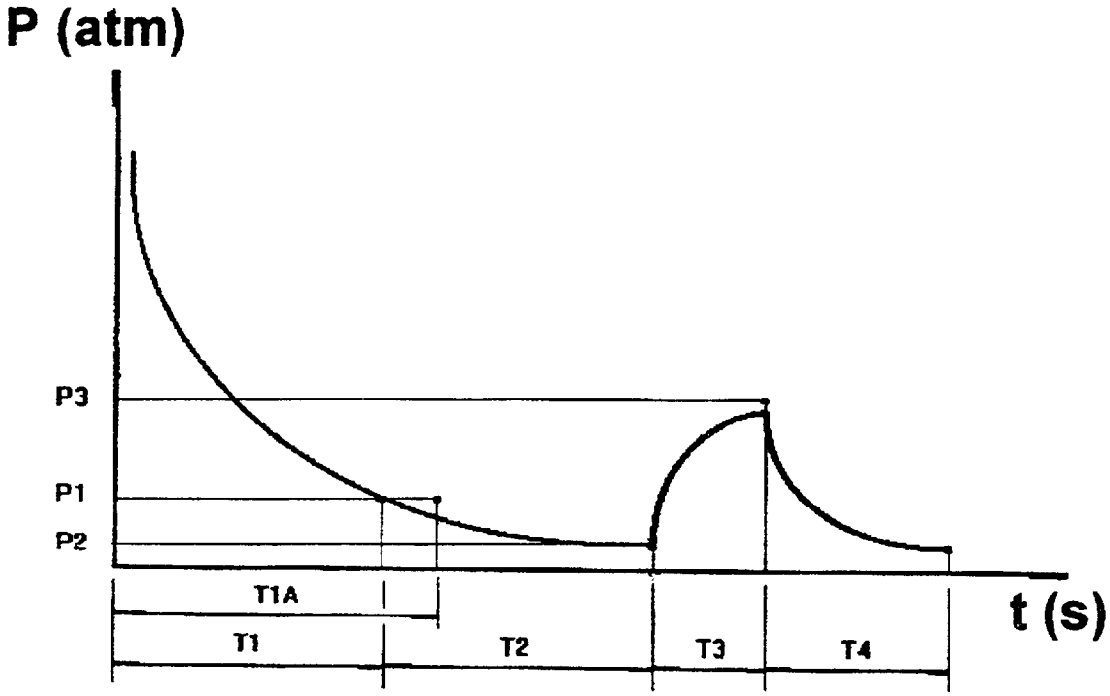
FIG. 4 illustrates a pressure-time variation curve, as a reference to the operation of the system for obtaining vacuum and fluid supply of the present invention.

In this third verification of the processing condition, the control unit 30 will verify the pressurization condition of the hermetic circuit 1 which is being processed and which has been positively evaluated in the previous verification steps, analyzing the pressure measured by the vacuum gauge 13 at the time instant t3, when the pressure in said refrigeration circuit being processed should have a value at maximum equal to p3, p3 being higher than p2 and p1. Pressure values in this verification step higher than p3 lead the control unit 30 to instruct the rejection of the hermetic circuit 1, as previously described in relation to the first and second verification steps (FIG. 4).

If pressure p measured during time interval t3 is lower than p3, the control unit 30 instructs the vacuum pump 12 to produce a vacuum condition in the refrigeration circuit so that to lead the pressure thereof to a value at maximum equal to the pressure t2 in a determined processing time interval. At a time instant t4, sufficient to allow the pressure in the refrigeration circuit being processed to reach the pressure at maximum equal to p2, the vacuum gauge 13 sends to the control unit 30 a signal corresponding to the pressure reached in said refrigeration circuit, said control unit 30 subsequently instructing to supply the refrigeration circuit with a determined charge of refrigerant fluid which is appropriate to the hermetic circuit 1 being processed.

The system and the process for supplying fluid in hermetic circuits of the present invention allow to completely eliminate the long interruptions between the processings of vacuum production and fluid supply of each hermetic circuit 1, eliminating the vacuum failures of the prior art resulting from these interruptions in the processes, eliminating as well the contaminations due to humidity and improving the quality of the final hermetic circuit 1.

Moreover, the system for obtaining vacuum and fluid supply of the present invention no more requires previous separation of the hermetic circuits 1 presenting the same processing characteristics, since it allows to identify these characteristics and then to specifically conduct the hermetic circuits 1 to a processing cell which is adequate for processing said hermetic circuits 1. Moreover, it is no more required from the hermetic circuits 1 already in the vacuum condition to wait for a future fluid supply in another unit, which in the past allowed the occurrence of vacuum failure and penetration of humidity in the refrigeration circuit. In order to avoid, upon removing a hermetic circuit 1 from a respective processing cell 10 in which it received a fluid charge, that a determined mass of said fluid found in the connecting means 80 of said processing cell 10 and between the valve elements of said connecting means 80 escape to the atmosphere, each connecting means 80 includes a third valve element 89, which is operatively and selectively coupled to a fluid recovery means, not illustrated, for instance by instruction of the control unit 30, after the closing of the first, second, third and fourth valve elements 82, 84, 87 and 88 and for example, before a hermetic circuit 1 already containing a respective fluid charge is removed from the processing cell 10. It should be understood that the opening and closing of the fifth valve element 89 may be manually effected.

As a function of the above characteristics, the system for obtaining vacuum and refrigerant fluid supply of the present invention allows to use different refrigerant fluids, with no possibility of occurring leakage of said fluid to the atmosphere. coupled to the control unit 30, in order to indicate to the latter the existence of a processing cell 10 which is vacant to receive a hermetic circuit 1 to be processed. According to the present invention, after identifying a hermetic circuit 1 by means of the reading unit 20, the control unit 30 programs one processing cell 10, indicated as vacant, with the characteristics of said hermetic circuit 1 to be processed, making this processing cell 10 able to receive and process said hermetic circuit 1.

In another option for carrying out the present invention, the identifying means is manually activated by an operator.

The characteristics associated with each hermetic circuit 1 are previously informed to the control unit 30 which stores these data in a memory unit 31, which also stores the data relative to each identified hermetic circuit 1 and to the processing data thereof. After identifying the hermetic circuit 1 to be processed, the control unit 30 instructs, for example simultaneously with the instruction for conducting this hermetic circuit 1 by the conveying means 50 to a processing cell 10, a respective fluid supply source 70, for example for supplying pressurized refrigerant fluid, to send a determined mass of refrigerant fluid under a determined pressure to the processing cell 10 which will receive the hermetic circuit 1 identified by the control unit 30. The fluid supply conditions are previously established and known by the control unit 30, according to each type of hermetic circuit 1 to be processed.

According to the present invention, a single fluid supply source 70 may be programed to either sequentially or simultaneously supply a determined amount of processing cells with hermetic circuits.

What is claimed is:

1. A system for supplying fluid in hermetic circuits, comprising a plurality of processing cells, each processing cell being adapted to receive a hermetic circuit and having connecting means mounted thereto connected to a vacuum pump and a fluid supply source, the connecting means being coupleable to the hermetic circuit and adapted to selectively and sequentially apply vacuum and fluid supply conditions to the hermetic circuit, a control unit operably connected to the connecting means to control operation thereof to selectively and sequentially apply vacuum and fluid supply conditions in the hermetic circuit, the vacuum and supply conditions being predetermined based upon the type of the hermetic circuit, and at least one reading unit operably associated with the control unit adapted to identify the type of the hermetic circuit and inform the control unit thereof by one of manual and automatic activation.

2. System as in claim 1, further comprising an occupation identification means operably coupled to each processing cell to determine an occupation condition thereof, the occupation means also being operably coupled to the control unit to inform the control unit of the occupation condition of each processing cell, and a conveying means adapted to transport a hermetic circuit between a receiving position and a positioning position in a processing cell identified as vacant by the control unit.

3. System as in claim 2, wherein the control unit instructs the conveying means to transport each hermetic circuit in the receiving position to a processing cell identified as vacant.

4. System as in claim 2, wherein the conveying means slides on guide rails.

5. System as in claim 2, wherein the occupation identification means includes presence sensing means for indicating the presence of a hermetic circuit in a processing cell.

6. System as in claim 5, wherein each processing cell is operably connected to one of the at least one reading unit.

7. System as in claim 5, wherein the at least one reading unit identifies the type of each hermetic circuit in the receiving position.

8. System as in claim 7, wherein the at least one reading unit is provided in the conveying means.

9. System as in claim 1, wherein the connecting means is operably associated with a vacuum gauge that informs the control unit of the vacuum and pressure conditions applied to the hermetic circuit coupled thereto.

10. System as in claim 9, wherein each processing cell is operably associated with a respective vacuum pump.

11. System as in claim 10, wherein the connecting means further comprises a vacuum terminal selectively connectable to the respective vacuum pump through a first valve element, a pressurization terminal selectively connectable with a respective supply source though a second valve element, and at least one evacuation and charging terminal selectively and manually connectable with a nozzle of the hermetic circuit.

12. System as in claim 11, wherein the connecting means further comprises a pair of evacuation and charging terminals respectively provided with a third and fourth valve elements whereby one is connectable to a nozzle in a low pressure side of a compressor-containing refrigeration circuit of the hermetic circuit and the other is connectable to a nozzle in a high pressure side of the refrigeration circuit.

13. System as in claim 12, wherein the connecting means further comprises a fifth valve element adapted to selectively connect the connecting means with a refrigerant fluid recovery circuit when said first, second, third and fourth valve elements are closed.

14. A process for supplying fluid to hermetic circuit compressors, comprising:

a) identifying the type of a hermetic circuit in a receiving position to be conducted to a processing cell;

b) identifying a vacant processing cell;

c) positioning a hermetic circuit in the vacant processing cell;

d) coupling at least one nozzle of the hermetic circuit to a connecting means that is selectively connectable to a vacuum pump and a respective fluid supply source of the vacant processing cell;

e) connecting the hermetic circuit to the vacuum pump and the respective fluid supply source via the connecting means;

f) providing a selective and sequential fluid communication of the connecting means to the vacuum pump and to the supply source so as to instruct the production of vacuum in the hermetic circuit and to instruct the supply of a fluid charge to the hermetic circuit after a predetermined vacuum condition based upon the type of the hermetic circuit has been obtained therein.

15. Process as in claim 14, further comprising instructing the vacant processing cell to receive a determined hermetic circuit, instructing the opening of first and third valve elements of the connecting means to apply the predetermined vacuum condition to the hermetic circuit; instructing the closing of the first valve element after the predetermined vacuum condition has been obtained; instructing the fluid communication to the supply source for a sufficient time to transfer to the hermetic circuit an amount of fluid determined by the type of hermetic circuit; instructing an interruption of the fluid communication and closing fourth valve element of the connecting means; closing the at least one nozzle; and instructing the removal of the hermetic circuit from the processing cell.

16. Process as in claim 15, further comprising the steps of opening a second valve element of the connecting means to apply a determined fluid supply condition to the hermetic circuit; and instructing the interruption of the fluid communication by closing the second valve element after the fourth valve element has been closed.

17. Process as in claim 16, further comprising instructing a conveying means to conduct the hermetic circuit from the receiving position to a positioning position in the processing cell; and instructing the conveying means to remove the hermetic circuit from the processing cell after the fluid supply to the hermetic circuit has finished.

18. Process as in claim 17, further comprising measuring vacuum in the hermetic circuit at least once during the step of producing vacuum therein and rejecting the hermetic circuit when the pressure exceeds a predetermined value.

19. Process as in claim 18, wherein the hermetic circuit is a refrigeration circuit having a compressor, the fluid communication is selectively interrupted between the vacuum pump and a low pressure side of the hermetic circuit, and upon the instructing of the opening of the second valve element, fluid communication is allowed between the respective fluid supply source and a high pressure side of the hermetic circuit.

20. Process as in claim 19, further comprising instructing the opening of a fifth valve element of the connecting means when the first, second, third, and fourth valve elements are closed to allow selective fluid communication between the connecting means and a refrigerant fluid recovery circuit.

* * * * *

UNITED STATES PATENT AND TRADEMARK OFFICE

CERTIFICATE OF CORRECTION

PATENT NO. : 6,508,065 B1 
DATED : January 21, 2003
INVENTOR(S) : Estevao Marino De Espindola et al.

It is certified that error appears in the above-identified patent and that said Letters Patent is hereby corrected as shown below:

Title page,
Add:
-- [30] Foreign Application Priority Data
March 2, 1998 (BR) …….. PI-9801296-7 --

Signed and Sealed this

Twenty-ninth Day of July, 2003

JAMES E. ROGAN
*Director of the United States Patent and Trademark Office*